US005332325A

United States Patent [19]

Crosnier et al.

[11] Patent Number: 5,332,325

[45] Date of Patent: Jul. 26, 1994

[54] APPLICATOR TUBE FOR LIQUID OR SEMI-LIQUID PRODUCTS

[76] Inventors: Daniel Crosnier, 14, rue Jacques Lanty,, 76550 Offranville; Jean-Marie Dulery, 52, rue Pierre Semard, 94210 La Varenne Saint Hilaire, both of France

[21] Appl. No.: 997,495

[22] Filed: Dec. 28, 1992

[30] Foreign Application Priority Data

Jan. 3, 1992 [FR] France ..... 92 00098

[51] Int. Cl.[5] ..... A45D 34/00; A45D 40/26

[52] U.S. Cl. ..... 401/119; 401/122; 401/123; 401/129; 401/130; 401/99; 401/143; 401/151; 401/191; 401/271; 401/274; 401/275

[58] Field of Search ..... 401/119, 122, 123, 124, 401/125, 129, 130, 99, 101, 102, 115, 274, 151, 145, 143, 191, 156, 271, 275

[56] References Cited

U.S. PATENT DOCUMENTS

| | | | |
|---|---|---|---|
| 1,876,197 | 9/1932 | Bassett | 401/119 |
| 2,311,367 | 2/1943 | Chambers . | |
| 2,685,387 | 8/1954 | Ganay . | |
| 2,691,184 | 10/1954 | Miller et al. . | |
| 3,246,657 | 4/1966 | Roller, Sr. | 401/119 X |
| 3,359,992 | 12/1967 | Cishek et al. | 401/102 |
| 4,029,422 | 6/1977 | Pillsbury | 401/99 X |
| 4,838,722 | 6/1989 | Katz | 401/101 |
| 4,880,326 | 11/1989 | Spivey et al. . | |
| 4,929,108 | 5/1990 | Gueret | 401/123 X |
| 4,941,598 | 7/1990 | Lambelet, Jr. et al. . | |
| 5,002,415 | 3/1991 | Gueret | 401/119 X |

FOREIGN PATENT DOCUMENTS

| | | | |
|---|---|---|---|
| 0320363 | 6/1989 | European Pat. Off. . | |
| 36749 | 8/1930 | France . | |
| 18768 | of 1888 | United Kingdom | 401/125 |

*Primary Examiner*—Steven A. Bratlie

*Attorney, Agent, or Firm*—Ostrolenk, Faber, Gerb & Soffen

[57] ABSTRACT

Applicator tube for cosmetic products, particularly mascara, having a tubular outer body. A cap fitted on one end of the tubular body has a rod attached to it, and an applicator is attached at the other end or the rod. The applicator is disposed inside the tubular body, in a longitudinally moveable part, and is removable therefrom to apply the cosmetic product. A removable container is at the lower end of the tubular body. A deformable part is disposed above the container whereby pressing down and releasing the cap causes mascara to be drawn into the applicator tube from the removable container to impregnate the applicator, which can then be withdrawn from the tubular body to apply the mascara. In another embodiment, the applicator moves between a retracted position inside the tubular body and an extended position when the removable container is pushed into the tubular body and thereafter withdrawn.

30 Claims, 2 Drawing Sheets

APPLICATOR TUBE FOR LIQUID OR SEMI-LIQUID PRODUCTS

BACKGROUND OF THE INVENTION

The present invention relates to an applicator tube for liquid or semi-liquid cosmetic products, in particular for mascara.

Known mascara tubes commonly comprise a small bottle containing the mascara which can be closed by a cap to which there is rigidly secured a rod having at its other end a spiral brush which permits application of the mascara to the eyelashes.

When the tube is closed, the rod and the brush extend into the mascara, and when the user removes one brush from the tube the brush passes through a constriction which serves to wipe it so as to eliminate the surplus mascara, the constriction being generally formed as a narrowing of the mouth of the bottle portion.

Such tubes, however, have a number of drawbacks. On the one hand, the user does not use all the product with which the brush is impregnated but generally only a third thereof, which raises the problem that the entire contents of the bottle may be contaminated by bacteria brought back in by the brush upon its reintroduction, making it necessary to add a large amount of preservatives to the product.

Furthermore, it is not possible to use the entire amount of the product contained within the bottle, in view of the length of the rod and the diameter of the brush, resulting in a loss for the consumer.

Still further, as the bottle is used, the amount of air contained in the bottle increases and the product dries out.

Finally, the mascara always accumulates on the rod, which results in progressive clogging of the cap and the danger of the end of the brush becoming stuck.

SUMMARY OF THE INVENTION

According to one of its principal features, the present invention is directed at overcoming these various drawbacks by proposing an applicator tube which comprises, within a tubular outer body, a measured-quantity distributing device on a removable container which is independent of the outer body.

Like the existing applicator tubes, the tube in accordance with the invention has means for applying the cosmetic product which are fitted to the end of a rod and may include a spiral brush for the application of mascara, or a small sponge for the application of a product of the liquid lip rouge type, a so-called "lip gloss".

When the tube is closed, the brush or sponge is positioned in a recess which communicates with the mouth of the measured-quantity distributing device.

The product is used by exerting pressure on the tube, for instance on one of its ends, which has the effect of releasing an amount of mascara which emerges from the container and spreads out in the recess, impregnating the brush. The user then takes out the brush which passes over a wiper.

The drawbacks of the existing devices are thus done away with; on the one hand, the reintroduction the brush cannot contaminate the mascara contained in the bottle part and, furthermore, all the product can be used. In addition, the product is not in contact with the air and therefore does not dry out. And finally, the rod need no longer be lengthy in order to reach the product in the bottom of the bottle, which makes it possible to use rather short rods, permitting greater precision in the application of the product.

The dosing device used may advantageously be that described in French Patent Application No. 91/03079, which corresponds to U.S. Ser. No. 07/816,767, filed by the applicants, which device, in addition to its efficiency, reliability and low cost, can be made in small size and therefore can be included in an external body the size of a pencil.

Several other embodiments of the present invention are possible, for example a tube having a telescoping rod which can be extracted by pressure exerted at the end of the tube. Pressing on the tube first of all creates the measured quantity and impregnates the brush with mascara, and then in a second stage causes the brush to be extracted from the tube.

Other features and advantages of the present invention will become apparent from the following description of preferred embodiments of the invention which refers to the accompanying drawings.

DETAILED DESCRIPTION OF EMBODIMENTS OF THE INVENTION

Figure 1:
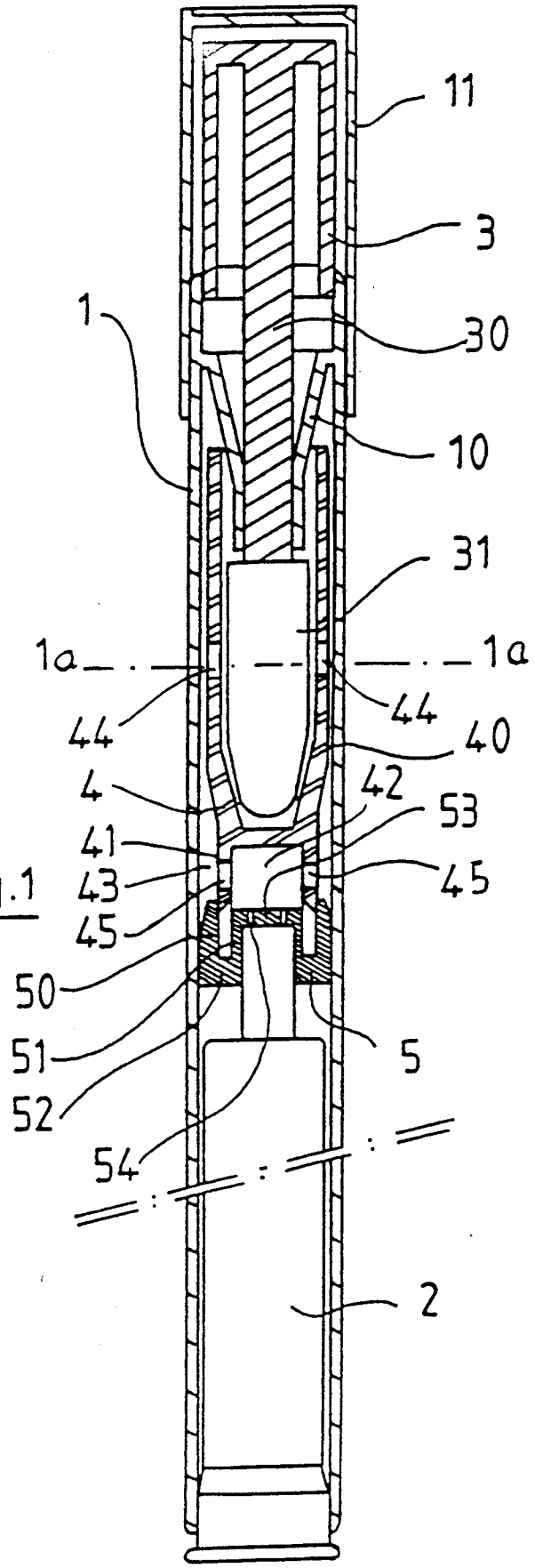
FIG. 1 is a view in longitudinal section of a first embodiment of an applicator tube in accordance with the invention.

Referring to FIG. 1, it can be seen that an applicator tube in accordance with a first embodiment of the invention has a tubular outer body 1, one end of which is open and permits the introduction of a removable container 2, while the other end has a narrowing 10 of frustoconical tubular shape constituting a wiper.

On the outer body 1 there is fitted a cap 3 which is firmly attached to a rod 30, the end of which is provided with a brush 31, which may be a spiral brush, a sponge, or the like, as mentioned above.

The brush 31 is arranged within the outer body 1 below the wiper 10 in a longitudinally moveable part 4 which comprises a middle portion 40 which surrounds the brush 31.

The lower end of the part 4 has a tubular portion 41 which defines a cylindrical space 42 and which, together with a deformable part 5 made of elastomer, constitutes a dosing device such as that described in French Patent Application No. 91/03079, which corresponds to U.S. Ser. No. 07/816,767.

Thus, the piece 5, which has a generally cylindrical shape, includes two concentric tubular parts 50 and 51 connected by an annular side 52, the upper opening of the inner tubular part 51 being covered by a wall 53 pierced with orifices 54. The end of the tubular part 41 of the piece 4 is inserted between the two tubular parts 50 and 51 and bears against the annular side 52.

Figure 1A:
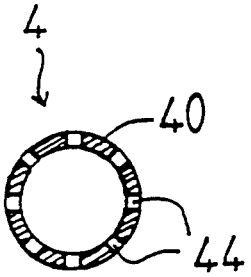
FIG. 1*a* is a sectional view taken along the line 1*a*—1*a* in FIG. 1.

Referring to FIG. 1*a*, it can be seen that the middle portion 40 of the part 4 has longitudinal slits 44, making it possible for the inside of the portion 40, and therefore the brush 31, to communicate with the outer space 43 outside the tubular portion 41.

The applicator tube is used, after removal of the outer cap 11 covering the cap 3, by exerting pressure on the cap 3, which has the effect, upon the first use, of expelling the air present in the cylindrical space 42 and deforming the elastomer part 5. When the elastomer part 5 resumes its initial shape upon relaxation of the pressure, a vacuum is created which draws in the mascara contained in the container 2 and fills the cylindrical space 42.

When the cap 3 is pressed again, the mascara contained in the cylindrical space 42 spreads into the space 43, by passing through the slits 45 formed in the tubular part 41, and deforms the external tubular part 50. Then the mascara passes from the space 43, into the interior of the part 4, by passing through the slits 44, where it impregnates the brush 31, which can then be extracted, the wiper 10 eliminating the surplus mascara.

Figure 2:
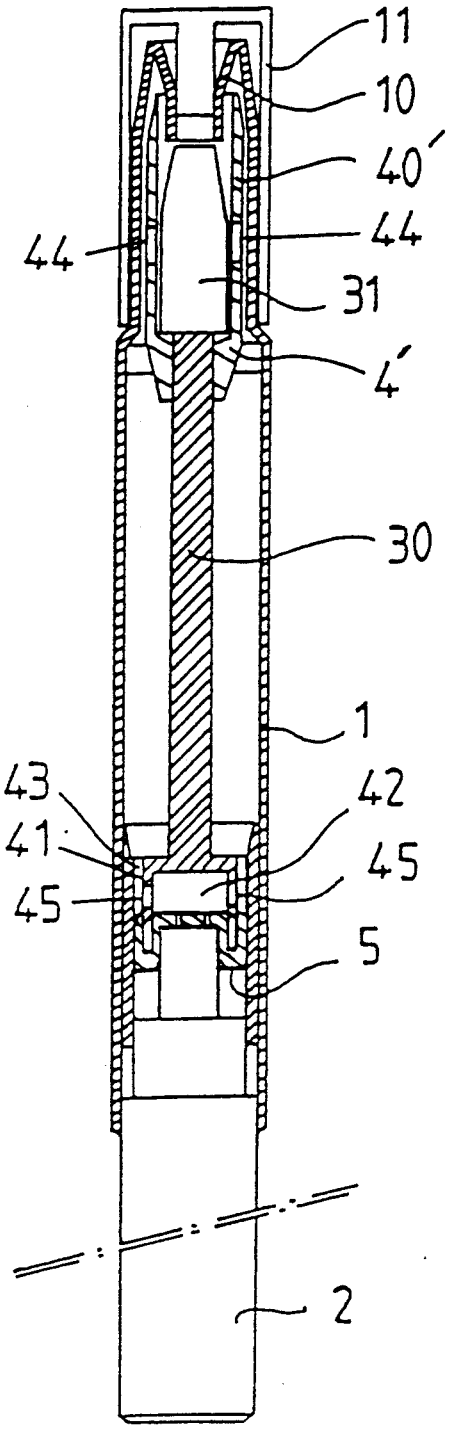
FIG. 2 is a longitudinal sectional view of a second embodiment of a tube in accordance with the invention, with a telescoping rod, shown in its closed position.
Figure 2A:
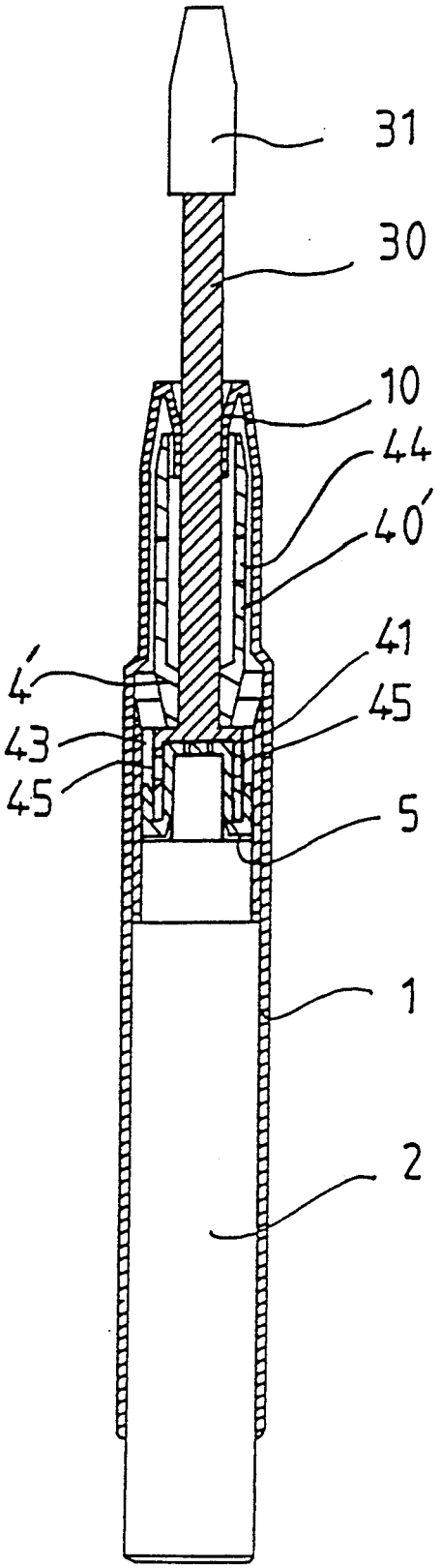
FIG. 2*a* is a longitudinal sectional view of the tube of FIG. 2, showing the tube extracted telescopically.

Referring now to FIGS. 2 and 2*a*, which show a second embodiment of the invention, it can be seen that the tubular portion 41 which forms part of the dosing device in association with the deformable elastomer part 5, is rigidly attached to the rod 30, but at the end opposite that having the brush 31. When pressure is applied to the container 2, the latter, in a first stage, pushes the rod 30 and causes the brush 31 to exit from the tube, and then, in a second stage, when the tubular portion 41 engages the sleeve part 4', the product contained in the cylindrical space 42 fills the inside of the portion 40' of the part 4'. Thus upon the reintroduction of the brush 31, the brush will be impregnated with a new dose of mascara and will be ready for use.

The extended brush 31 may be returned into the tube portion 40', after application of the mascara, either by pushing the brush 31 with the cap 11, or by pulling the container 2 out. As in the first embodiment, the mascara passes from the cylindrical space 42 to the space 43 through slots 45 provided in the tubular portion 41. After deforming the annular portion 50 of the deformable elastomer part 5, the mascara spreads in the space 43 from which it passes through slots 44 of the sleeve part 4' into the portion 40' to impregnate the brush 31.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for dosaging measured quantities of liquid or semi-liquid cosmetic products from a removable container having a cosmetic product stored therein, the device comprising:

an outer body including means for receiving the removable container so that contact between air outside the removable container and the product inside the container is substantially prevented at all times;

an applicator for applying the cosmetic product, the applicator being disposed inside the outer body and removable therefrom to apply the cosmetic product;

providing means inside the outer body for providing the applicator with a measured quantity of the product, the providing means including a part formed with a predetermined space therein corresponding to the measured quantity; connecting means for connecting the predetermined space to the applicator so that the measured quantity of product can pass from the predetermined space through the connecting means to the applicator; and deformable means associated with the providing means for drawing product from the removable container into the predetermined space;

wherein the providing means cooperates with the deformable means so that when the deformable means is deformed, the aforementioned measured quantity of the product passes from the predetermined space into the connecting means and toward the applicator, and when the deformable means is released a suction is formed in the predetermined space so that the measured quantity of product is drawn from the container into the predetermined space.

2. An applicator as in claim 1, further comprising a wiper, the wiper being provided in the outer body adjacent the applicator so as to wipe the applicator when the applicator is removed from the outer body for applying the cosmetic product.

3. An applicator as in claim 2, wherein the wiper is a narrow portion of frustoconical tubular shape inside the outer body.

4. An applicator as in claim 1, wherein the connecting means includes longitudinal slits provided in the part of the providing means.

5. An applicator as in claim 1, wherein the deformable means includes orifices which permit the product to pass from the container to the predetermined space in the part.

6. An applicator as in claim 5, wherein the deformable means has a generally cylindrical shape; and comprises two concentric tubular parts, the concentric tubular parts being connected by a lower annular side of the deformable means; an upper opening of the inner tubular part being covered by an upper wall to form a space therebelow, said orifices being formed in said upper wall.

7. An applicator as in claim 6, wherein the outer body is open at an end for receiving the container.

8. An applicator as in claim 7, wherein the providing means is longitudinally moveable inside the outer body, and the deformable means is deformed by pushing the applicator into the outer body.

9. An applicator as in claim 7, wherein the container is longitudinally moveable inside the outer body, and the deformable means is deformed by pushing the container into the outer body.

10. A device for dosaging measured quantities of liquid or semi-liquid cosmetic products from a removable container having a cosmetic product stored therein, the device comprising:

a cap having a rod, an applicator for applying the cosmetic product being provided at an end of the rod;

an outer body, the cap fitting one end of the outer body so that the applicator extends into the outer body, and is removable from the outer body for applying the cosmetic product; the outer body including means for receiving the removable container so that contact between air outside the removable container and the product inside the container is substantially prevented at all times;

a longitudinally moveable part inside the outer body, the moveable part having an end portion, a predetermined space formed in the end portion corresponding to a measured quantity of product; connecting means for connecting the predetermined space to the applicator so that the measured quantity of product can pass from the predetermined space through the connecting means to the applicator; and a deformable part associated with the moveable part for drawing product from the removable container into the predetermined space in the end portion;

wherein the movable part cooperates with the deformable part so that when the deformable part is deformed, the aforementioned measured quantity of the product passes from the predetermined space into the connecting means and toward the applicator, and when the deformable part is released a suction is formed in the predetermined space so that the measured quantity of product is drawn from the container into the predetermined space.

11. An applicator according to claim 10, wherein the outer body is open at a lower end for receiving the container.

12. An applicator according to claim 10, wherein the connecting means include longitudinal slits provided in the end portion, respectively.

13. An applicator according to claim 10, wherein the applicator is a brush.

14. An applicator according to claim 10, wherein the applicator is a sponge.

15. A device for dosaging measured quantities of liquid or semi-liquid cosmetic products from a removable container having a cosmetic product stored therein, the device comprising:

a rod having at one end an applicator for applying the cosmetic product and at the other end a tubular portion, the tubular portion having a predetermined space formed therein corresponding to a measured quantity of product;

an outer body having a sleeve part, the rod being disposed inside the outer body so that the applicator is capable of moving between a retracted position inside the sleeve part and an extended position outside the outer body to apply the cosmetic product;

the outer body including means for receiving the removable container so that contact between air outside the removable container and the product inside the container is substantially prevented at all times;

connecting means for connecting the sleeve part and the predetermined space so that the measured quantity of product can pass from the predetermined space through the connecting means to the applicator inside the sleeve part; and a deformable part associated with the rod for drawing the measured quantity of product from the removable container into the predetermined space;

wherein the rod cooperates with the deformable part so that when the deformable part is deformed, the aforementioned measured quantity of the product passes from the predetermined space into the connecting means and toward the applicator in the sleeve part, and when the deformable part is released a suction is formed in the predetermined space so that the measured quantity of product is drawn from the container into the predetermined space.

16. An applicator according to claim 15, wherein the connecting means includes longitudinal slits provided in the sleeve part and the tubular portion, respectively.

17. An applicator according to claim 15, wherein the applicator is a brush.

18. An applicator according to claim 15, wherein the applicator is a sponge.

19. An applicator as in claim 1, wherein the outer body has a generally cylindrical shape.

20. An applicator as in claim 1, wherein the providing means has another part surrounding the applicator, the connecting means including longitudinal slits provided in both parts of the providing means so as to connect the predetermined space to the applicator.

21. An applicator according to claim 10, wherein the outer body is generally cylindrical in shape.

22. An applicator according to claim 10, wherein the longitudinally movable part includes an upper portion surrounding the applicator, the end portion being generally tubular in shape, and the predetermined space formed in the tubular end portion being generally cylindrical in shape; the connecting means including longitudinal slits provided in the upper portion and the tubular end portion, respectively, so as to connect to the predetermined space to the applicator.

23. An applicator according to claim 10, wherein the deformable part is disposed at the end portion of the moveable part so that when the movable part is moved in a first direction into the outer body the deformable part is deformed, and when the movable part is thereafter moved in a second direction, opposite to the first direction, the deformable part is released.

24. An applicator according to claim 23, wherein the movable part is moved in the first direction when the cap is pressed down to push the applicator into the outer body, and the movable part is thereafter moved in the second direction when the cap is released.

25. An applicator according to claim 10, wherein the outer body includes a narrow portion, the applicator extending into the outer body to a portion in the outer body such that the applicator is located below the narrow portion so as to be wiped by the narrow portion when the applicator is removed from the outer body.

26. An applicator according to claim 15, wherein the outer body is generally cylindrical in shape.

27. An applicator according to claim 15, wherein the predetermined space is generally cylindrical in shape.

28. An applicator according to claim 15, wherein the removable container is disposed at a lower end of the outer body so as to be longitudinally movable therein, the deformable part is deformed when the removable container is moved in a first direction into the outer body, and the deformable part is released when the removable container is moved in a second direction opposite to the first direction.

29. An applicator according to claim 28, wherein the applicator is moved toward the extended position when the removable container is moved in the first direction and the applicator is moved toward the retracted position when the removable container is moved in the second direction.

30. An applicator according to claim 15, wherein the outer body includes a narrow portion, the narrow portion being positioned inside the outer body so as to wipe the applicator when the applicator moves between the retracted position and the extended position.

* * * * *